United States Patent [19]

Bier et al.

[11] Patent Number: 5,026,987

[45] Date of Patent: Jun. 25, 1991

[54] MASS SPECTROMETER WITH IN-LINE COLLISION SURFACE MEANS

[75] Inventors: Mark E. Bier; Robert G. Cooks, both of W. Lafayette, Ind.; George C. Stafford, San Jose, Calif.

[73] Assignees: Purdue Research Foundation, Lafayette, Ind.; Finnigan Corporation, San Jose, Calif. ; a part interest

[21] Appl. No.: 528,900

[22] Filed: May 23, 1990

Related U.S. Application Data

[63] Continuation of Ser. No. 201,592, Jun. 2, 1988, abandoned.

[51] Int. Cl.[5] ..... H01J 49/26

[52] U.S. Cl. ..... 250/281; 250/292

[58] Field of Search ..... 250/281, 282, 296, 423 R, 250/292

[56] References Cited

U.S. PATENT DOCUMENTS

| | | | |
|---|---|---|---|
| 4,234,791 | 11/1980 | Enke et al. | 250/281 |
| 4,328,420 | 5/1982 | French | 250/282 |
| 4,329,582 | 5/1982 | French et al. | 250/292 |
| 4,835,383 | 5/1989 | Mahoney et al. | 250/281 |
| 4,851,669 | 7/1989 | Aberth | 250/282 |

OTHER PUBLICATIONS

R. G. Cooks et al., "Anomalous Metastable Peaks'-'/Intl. Journal of Mass Spect. and Ion Physics, 16 (1975) pp. 348-352.

M. J. Dekrey, MD et al., "Applications of Linked Scan Procedures in Investigating Polyatomic Ion/Surface Interactions"/Intl. Journal of Mass Spect. and Ion Processes, 67 (1985) pp. 295-303.

MD.A. Mabud et al., "Surface-Induced Dissociation of Molecular Ions"/Intl. Journal of Mass Spectrometry and Ion Processes, 67 (1985) pp. 285-294.

MD.A. Mabud et al., "Charge Exchange of Doubly Charged Organic Ions at Metal Surfaces"/Intl. Journal of Mass Spectrometry & Ion Processes, 69 (1986) 277-284.

J. N. Louris, et al., "New Scan Modes Accessed With a Hybrid Mass Spectrometer"/American Chemical Society 1985, pp. 2918-2924.

M. E. Bier et al., "A Tandem Quadrupole Mass Spectrometer for the Study of Surface-Induced Dissociation"/Intl. Journal of Mass Spectrometry and Ion Processes, 77(1987) pp. 31-47.

R. G. Cooks et al., "Surface Modified Mass Spectrometry"/Journal of the American Chemical Society, 97 1583 (1975).

Amos S. Newton et al., "Autoionization of Highly Excited Ar+ Ions Produced by Electron Impact"/Journal of Chemical Physics, vol. 47, #11 (12/1967) 4843-4849.

R. M. Gandy et al., "Modification of a Time-of-Flight Mass Spectrometer for Studies in Collisionally Induced Dissociations"/Intl. Journal of Mass Spectrometry and Ion Physics, 24 (1977) pp. 363-371.

R. L. Alcorn et al., "Surface Collisionally-Activated Dissociation (SCAD): A Solution to the Cluster Interference Problem in SIMS"/Dept. of Chemistry, Arizona State University/pp. 153-157.

K. Okuno et al., "Collision-Induced Ionization of Highly Excited Argon Ions"/Dept. of Physics, Tokyo Metropolitan Univ. Press/1970 pp. 830-836.

*Primary Examiner*—Jack I. Berman

*Attorney, Agent, or Firm*—Flehr, Hohbach, Test, Albritton & Herbert

[57] ABSTRACT

A mass spectrometer including at least one mass analyzer into which an ion beam to be analyzed is projected having a collision surface means in-line with the ion beam to form surface collision products which are directed into the in-line mass analyzer.

12 Claims, 6 Drawing Sheets

MASS SPECTROMETER WITH IN-LINE COLLISION SURFACE MEANS

This is a continuation of application Ser. No. 201,592 filed on June 2, 1988, now abandoned.

BRIEF DESCRIPTION OF THE INVENTION

This invention relates generally to tandem mass spectrometers including an ion collision surface means which is in line with the ion beam entering the subsequent mass analyzer.

BACKGROUND OF THE INVENTION

In tandem mass spectrometry, ions formed in a source are mass analyzed by means of an analyzing element, such as a magnet sector, quadrupole or hybrid system. Ions of a selected mass are then introduced into a region of the spectrometer in which a relatively high pressure of a selected gas in present. These ions then interact with the gas atoms or molecule in such a way that the internal energy of the ion is increased to the point where fragmentation of the ion occurs. The resulting fragments, in particular those having an ionic charge, are further mass analyzed and identified.

Tandem Mass Spectrometry has been described by (a) F.W. McLafferty, Ed., "Tandem Mass Spectrometry", John Wiley and Sons, Inc., 1983; (b) R.G. Cooks, in "Collision Spectroscopy", R.G. Cooks, Ed., Plenum Press, 1978, p.357; (c) R.W. Kondrat and R.G. Cooks, *Anal. Chem.*, 50 (1978), A81; (d)F.W. Crow, K.B. Tomer, and M.L. Gross, *Mass Spectrom. Rev.*, 2 (1983), 47. In U.S. Pat. Nos. 4,234,791, 4,328,420 and 4,329,582 there is disclosed a tandem quadrupole-based mass spectrometer including a highly efficient intermediate fragmentation stage. The disclosed fragmentation stage employs collision-induced dissociation (CID), in an electrodynamic focus device, which may be a quadrupole operated as a broad band filter mode. This process of fragmentation (CID) is a controlled process compared with ionization processes which occur in traditional mass spectrometry sources. As a result, the types of fragmentations which occur can be more readily interpreted in terms of the structures of the intact species. This feature, and the advantages of two stages of mass analysis in improving selectivity of detection, has resulted in MS/MS being widely used in qualitative and quantitative molecular analysis, in ion structural studies, and in gas phase ion chemical investigations. Larger molecules, in particular, resist fragmentation in CID because the energy supplied is rapidly distributed among the many internal degrees of freedom of the species. Larger energies are needed to overcome this problem. This is of particular significance in the application of mass spectrometry to the biological sciences.

Dissociation of molecules on collision at surfaces has been reported by R.G. Cooks, T. Ast, and J.H. Beynon, *Int. J. Mass Spectrom. Ion Phys.*, pg.348, 16 (1975), among others. The interactions of polyatomic ions with surfaces have been shown to be a source of information on the nature of the ionic species as well as the properties of the surface, M.A. Mabud, M.J. DeKrey and R.G. Cooks, *Int. J. Mass Spectrom Ion Physics*, 67, 285 (1985). Processes which occur include charge transfer, ion/surface reactive collisions, sputtering, reflection (elastic collisions) and inelastic collisions leading to dissociation of the emerging ion, M.S. Mabud, M.J. DeKrey, R.G. Cooks and T. Ast, *Int. J. Mass Spectrom Ion Proc.*, 69, 277 (1986). This last process offers the possibility of supplementing or replacing gas phase collisions in tandem mass spectrometry (MS/MS). A tandem spectrometer has been constructed using a magnetic sector and a quadrupole mass filter arranged so that the angle made between the direction of motion of the ion emerging from the first mass analyzer and the direction of motion of that entering the second analyzer was large, 90°, M.J. DeKrey, M.A. Mabud, R.G. Cooks and J.E.P. Syka, *Int. J. Mass Spectrum Ion Proc.*, 67, 295 (1985) and 77, 31 (1987).

SUMMARY AND OBJECTS OF THE INVENTION

It is an object of the present invention to provide a tandem mass spectrometer with an in-line device for dissociation and other ion surface collision processes including sputtering, charge exchange, etc.

It is another object of the present invention to provide a tandem mass spectrometer having spaced first and second analyzer stages with an ion surface collision means disposed between the analyzer stages and in line with the ion beam leaving the first stage and entering the second stage.

It is a further object of the present invention to provide a tandem mass spectrometer having an ion collision means which is simple in construction.

It is a further object of the present invention to provide a tandem mass spectrometer having an in-line ion collision means in which the ion collision energy can be controlled over a wide range of energies.

It is a further object of the present invention to provide a tandem mass spectrometer employing a surface induced dissociation process which is highly efficient and which enhances the ability of a tandem mass spectrometer to perform large molecule studies.

The foregoing and other objects of the invention are achieved by ion collision means placed in-line with the ion beam directed to a mass analyzer.

The objects of the invention are further achieved by a tandem mass spectrometer including: a source capable of ionizing a sample to produce ions; first and second mass analyzers; an in-line ion collision means between said mass analyzers; means for directing ionized sample from the source into the first analyzer where it is analyzed and emerges as an ion beam directed to the second analyzer and collides with said collision surface; means for directing said ions, ion fragments or ion components from the ion collision means into said second mass analyzer; and, a detector responsive to the output of said second analyzer.

BRIEF DESCRIPTION OF THE DRAWINGS

The foregoing and other objects of the invention will be more clearly understood from the following description read in conjunction with the drawings of which.

DESCRIPTION OF THE PREFERRED EMBODIMENTS

Figure 1:
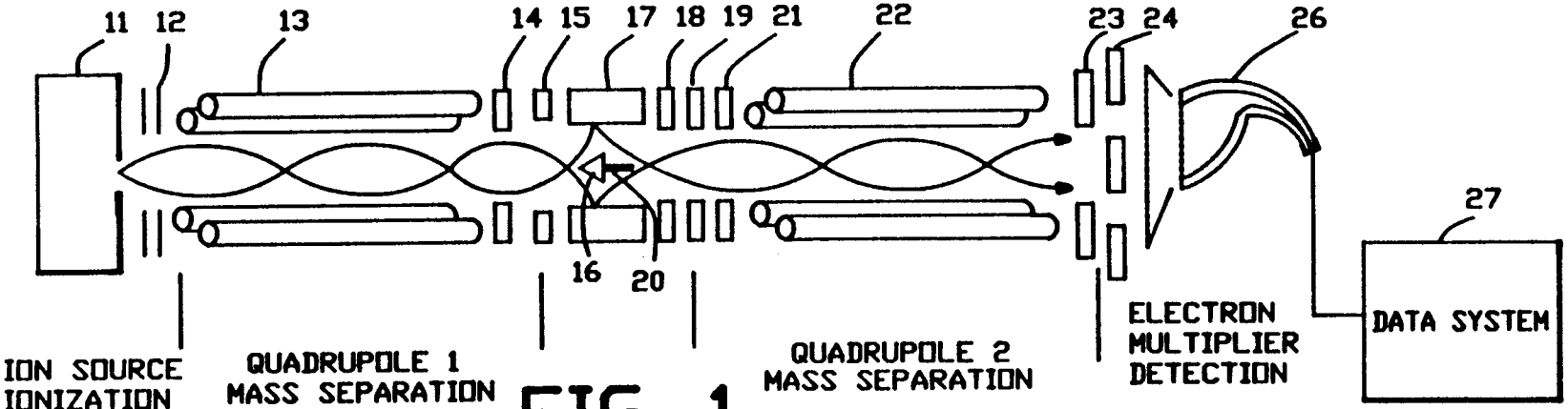
FIG. 1 is a schematic view of a tandem quadrupole mass spectrometer including an in-line collision surface means.

A tandem quadrupole mass spectrometer embodying the present invention is schematically illustrated in FIG. 1. The tandem spectrometer includes an ion source 11 which can be an EI, CI, or other ion source of the type well known in the art. Ions from the source are focused and directed by one or more apertures 12 to the entrance of a first mass analyzer, a quadrupole mass analyzer or filter 13 is shown. The ions emerge from the mass analyzer 13 and flow in-line past first and second apertures, or lenses, 14 and 15. The aperture 15 includes support means to support axial deflector 16. An ion collision surface 17 surrounds the deflector 16. Ions leaving the in-line ion collision surfaces are focused by three aperatures, or lenses, 18, 19 and 21 into the entrance of a second analyzer, quadrupole mass analyzer or filter 22. The ions which are filtered or analyzed by the mass analyzer 22 travel through apertures, or lenses, 23, 24 and impinge onto an electron multiplier 26 whose output is connected to a data system 27.

The tandem quadrupole mass spectrometer can be operated as a conventional tandem mass spectrometer by application of suitable voltages to the apertures and ion collision surfaces whereby ions travel through and past the in-line collision means from the first analyzer 12 to the second analyzer 22.

The operation of quadrupole mass analyzers or spectrometers is well known and is described in Paul et al. U.S. Pat. No. 2,939,952. The quadrupole spectrometer may include four elongated electrodes arranged about a central axis. Opposite pairs of electrodes are interconnected. In operation, superimposed RF and DC voltages are applied to the pairs of rods and the ion beam is directed along the axis. Depending upon the particular RF and DC potential applied, only ions of selected charge-to-mass ratios pass through the quadrupole with the remaining ions following unstable trajectories leading to escape from the quadrupole field. The unstable ions may impact upon the quadrupole rods or on the surrounding envelope and are neutralized.

In the tandem quadrupole mass spectrometer of FIG. 1, the first and second analyzers 12 and 22 are operated as above described and operate in the ion selection mode.

In accordance with the present invention, an in-line ion collision surface is provided. With selected voltages applied to the apertures and to the surfaces 16 and 17, the in-line ions may be caused to impinge either upon the cylindrical surface 17, FIG. 4, or upon the conical surface 16, FIG. 5. Depending upon the energy supplied to the ions, that is, the accelerating voltages applied to the ions by the apertures, and the voltages applied to the surfaces 16 and 17, the ions impinging upon the surfaces may be partially reflected from the surface or may strike the surface and be fragmented. When very gentle impact occurs, the result is reflection of the ions. As the energy is increased, fragmentation of the ions takes place and one can observe both low and high energy processes by proper adjustment of the voltages. The in-line collision surface provides a tool for both reproducing the processes observed in gas phase CID, but also fragmenting large molecules and observing high energy processes. The results may be that the organic ions can be reflected intact from the surfaces in relative yields which depend upon a particular ion chosen. By setting both analyzers to monitor ions of the same mass-to- charge ratio, it is possible to observe the extent to which different ions are reflected from the surface. This may provide a source of information on the chemical nature of surfaces.

Figure 3:
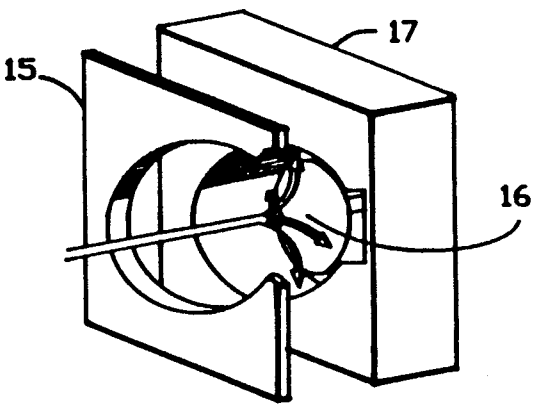
FIG. 3 is an enlarged perspective view of the collision means showing the ion beam.
Figure 2B:
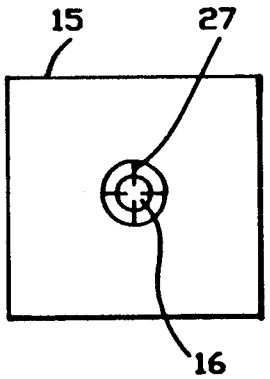
FIGS. 2A and 2B show an enlarged view of the in-line surface collision means of FIG. 1.
Figure 2A:
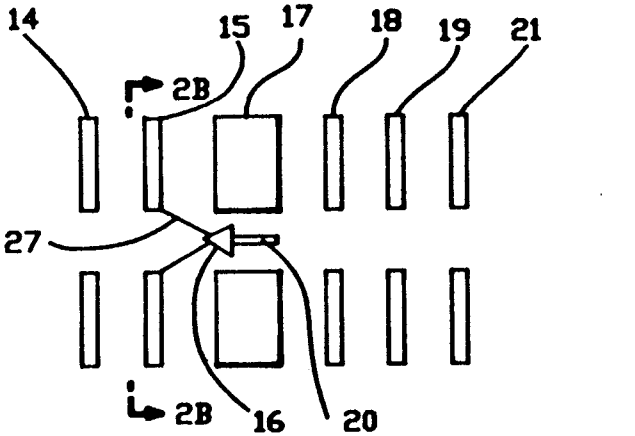

Referring more particularly to FIGS. 2A and 2B, the in-line device of FIG. 1 comprises two apertures or electrodes which serve to provide fields for accelerating, focusing and collimating the ion beam traveling along the axis of the first quadrupole and towards the second quadrupole. The collision surfaces may comprise the inside surfaces of the collision member 17 or may comprise the outer surface of the conical member 16. The ions striking these surfaces are then reflected with forward energy at a reduced velocity whereby they can be focused by the succeeding electrodes 18, 19 and 21 into the second quadrupole where they are analyzed. The conical member 16 is supported by aperture 27 which extend radially from the electrode 15 and support the cone in its axial position The conical member 16 may include an integral tail 20 which cooperates with the surface 17 and aperture 18 to provide improved focusing fields. The tail 20 may also be separate and have a different applied voltage. Referring to FIG. 3, a schematic perspective view of an ion beam 28 is shown moving towards the cone 16 where it is shown deflected outwardly to impinge upon the inner surface of the collision member 17.

Figure 4:
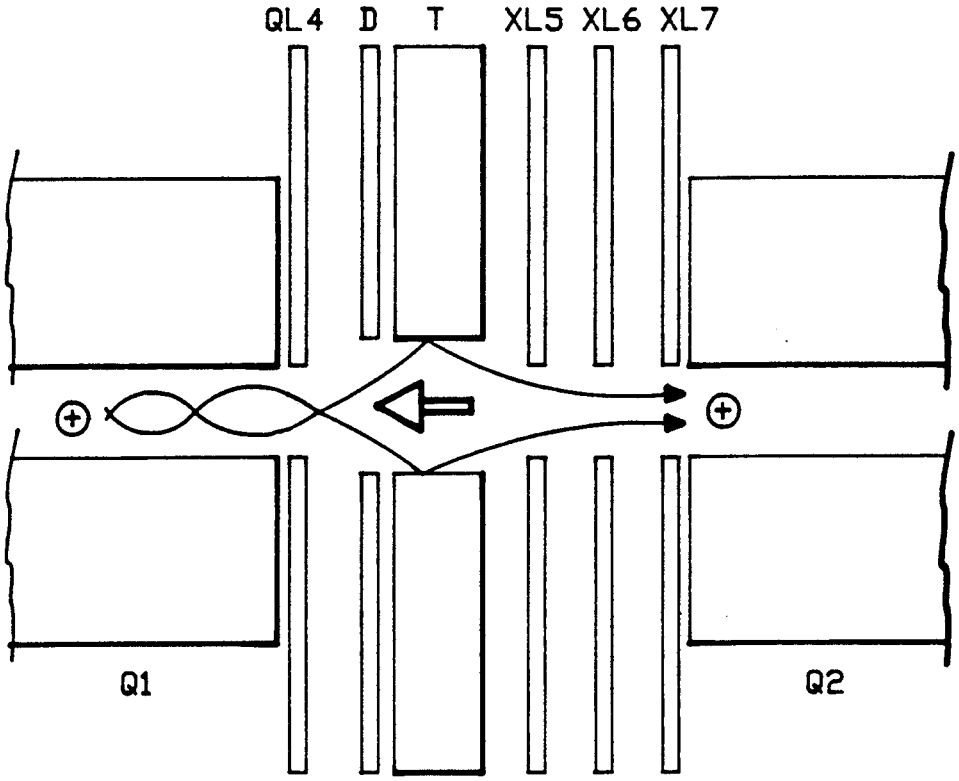
FIG. 4 shows the ion flow in a collision means in one method of operation.
Figure 5:
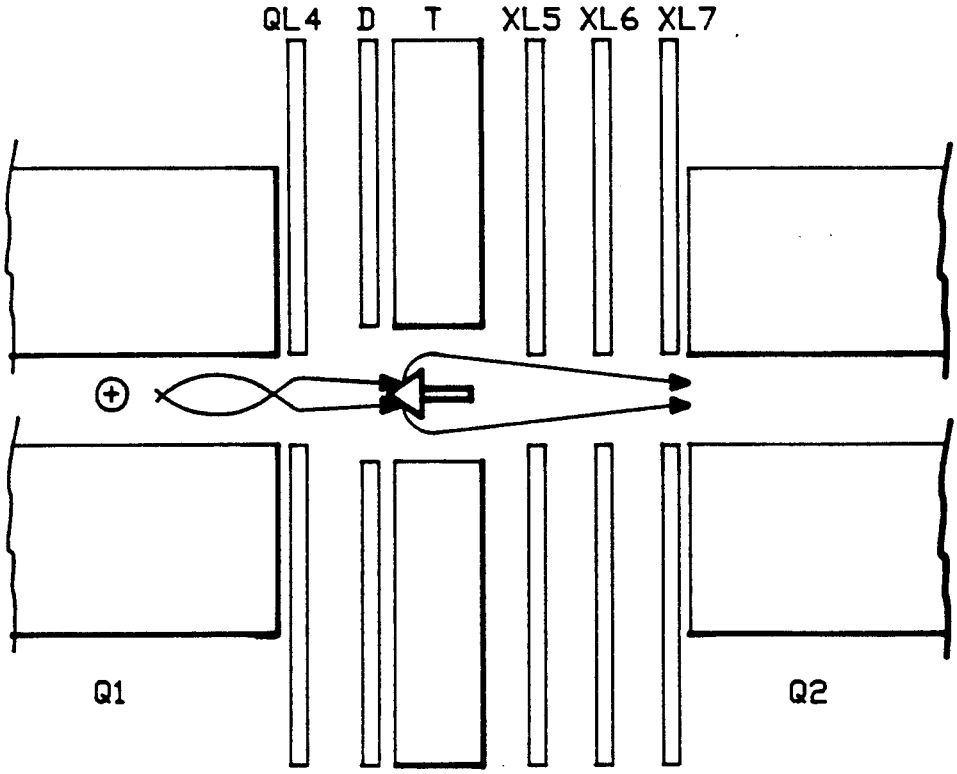
FIG. 5 shows the ion flow in the surface collision means for another method of operation.

Referring to FIG. 4 and 5, the ion beam is shown either colliding with the surface 17 or with the surface 16 depending upon the voltages applied. The ions leaving the surface, whether fragment ions or deflected ions, have reduced velocity and are then focused by the fields in the succeeding apertures or electrodes 18, 19 and 21 and travel into the second analyzer 22.

It is seen that the collision surface is an in-line surface which can be implemented in a number of geometries in addition to the one just described. The in-line feature facilitates the alignment of the succeeding analyzer and the focusing of the ions leaving the collision surface into the entrance to the succeeding analyzer. The secondary or reflected ions which are generated through ion/surface collisions will be ejected into a range of angles with various kinetic energies. These ions are electrostatically deflected by the fields in such a fashion that they will avoid the target surfaces and continue beyond it into the second mass analyzer. The device can be used with primary ions in the eV or the kV range of kinetic energy. The secondaries always have lower kinetic energies than the primary and hence they can be deflected using field strengths which allow transmission of the primary beam.

Figure 6:
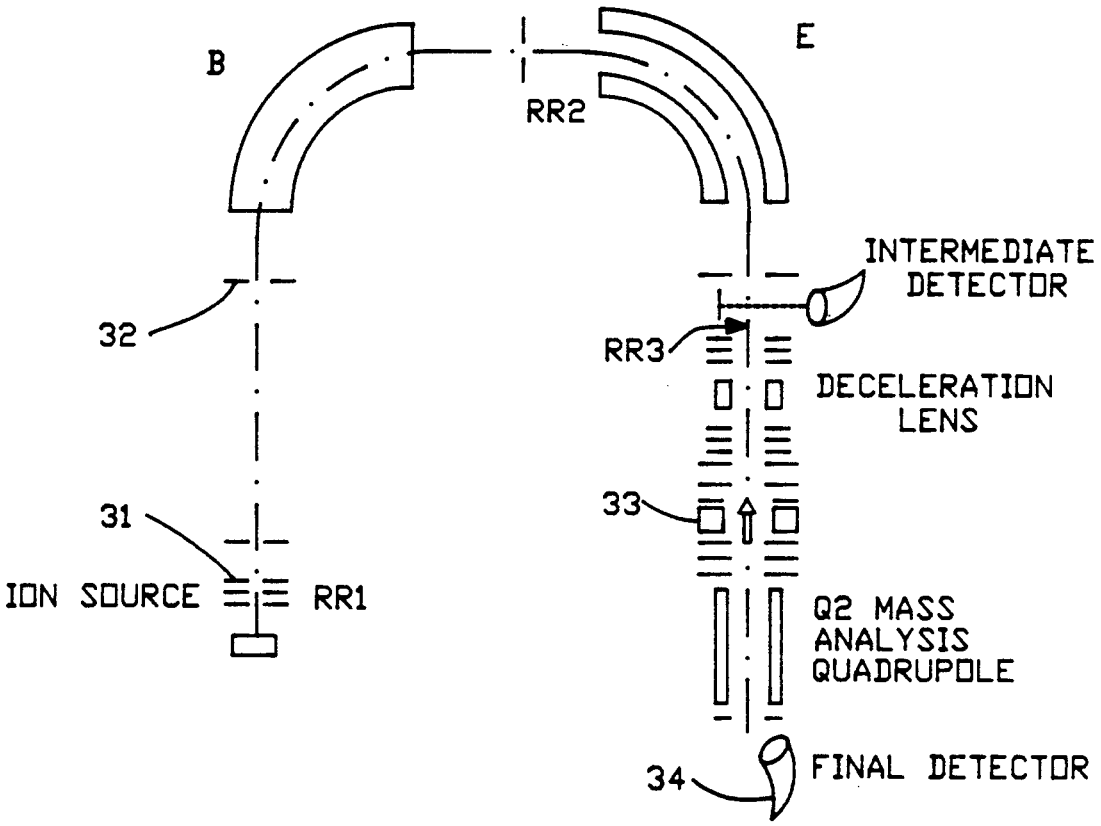
FIG. 6 shows an in-line ion surface collision means in a BEQ mass spectrometer.
Figure 7:
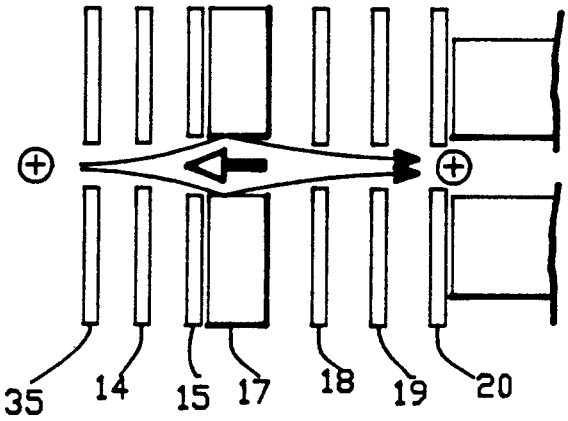
FIG. 7 is an enlarged view of the ion surface collision means of FIG. 6.

In FIG. 6 there is shown an in-line collision surface in a BEQ mass spectrometer. In the device an ion source 31 provides ions to a magnetic sector B via apertures 32. The ions travel to the electrostatic sector E through the in-line collision means 33 through a quadrupole mass analyzer Q to a detector 34. FIG. 7 is an enlarged view of the in-line surface collision means. The same reference numerals have been applied as to parts like those of FIG. 1. The in-line surface collision means includes an additional aperture 35.

Figure 8:
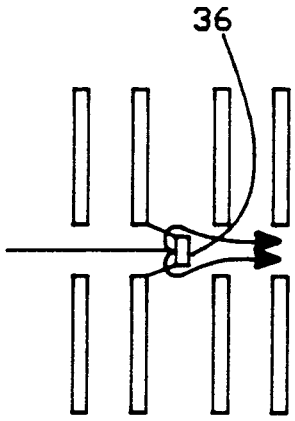
FIG. 8 shows another surface collision means.
Figure 9:
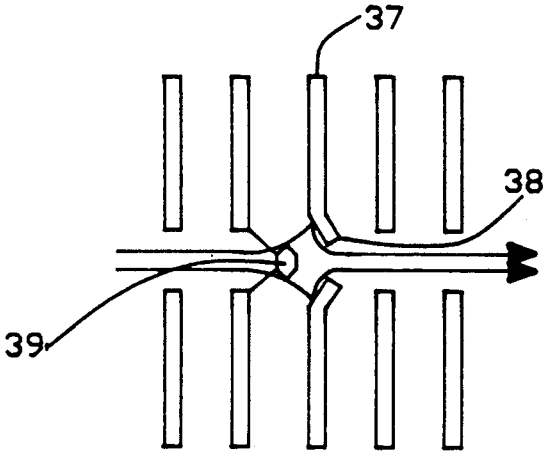
FIG. 9 shows still another surface collision means.
Figure 10:
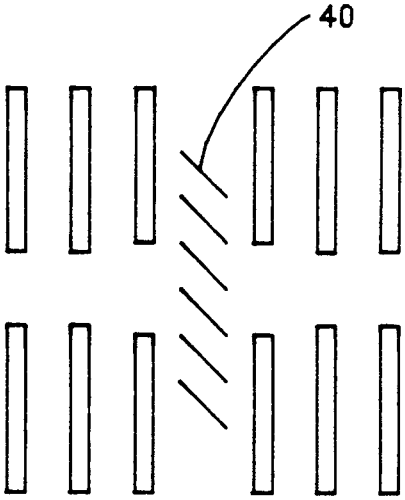
FIG. 10 shows a further ion surface collision means.

Although a preferred embodiment of the invention has been described, the in-line collision surface can take other shapes and forms. For example, as shown in FIG. 8, the surface may be a flat disc-like surface 36 on which the ions impinge perpendicularly and the fragments are deflected by the electrostatic fields to miss the target and pass onwardly to the succeeding quadrupole mass analyzer In FIG. 9, one of the grids 37 is formed with a conical surface 38 and a deflector 39 which may be in the form of a sphere or other surface, is disposed adjacent to the conical surface and serves to deflect the ion beam so that the ions strike the conical collision surface 38 and are deflected to the succeeding mass analyzer by the succeeding grids. FIG. 10 shows a collision surface comprising parallel spaced overlapping angled surfaces 40.

Figure 11:
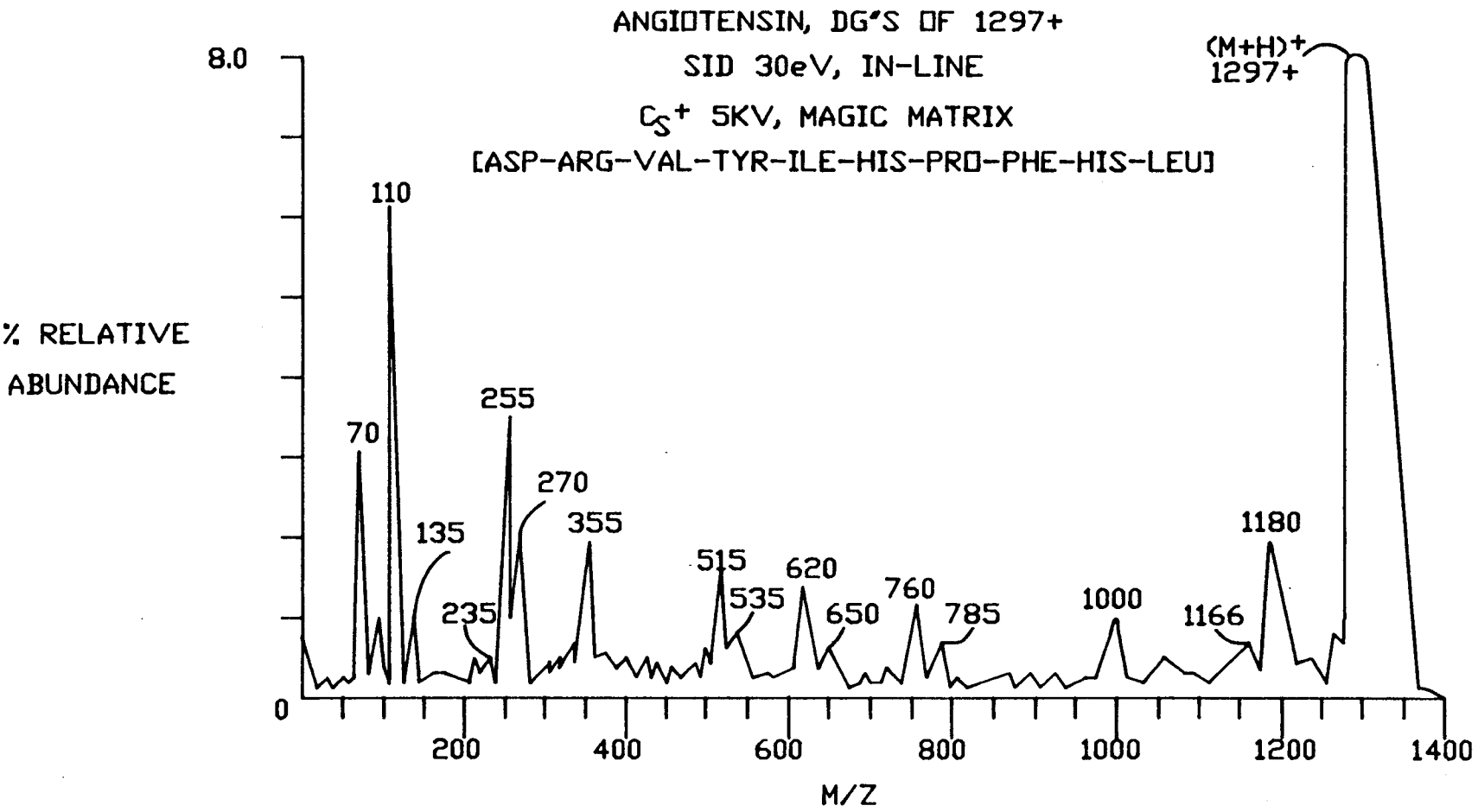
FIG. 11 shows a mass spectra of Angiotensin obtained with the tandem mass spectrometer of FIG. 1.

The mass spectrometer shown in FIG. 1 was operated with the following voltages:

Quadrupole I −8.4 offset
Aperture 14 −1.94
Aperture 15 −12
Surface 17 −30
Aperture 18 −114
Aperture 19 −40
Aperture 21 −15
Quadrupole 2 −88 offset
Aperture 23 −31
Aperture 24 +56
Dynode 26 −5 kV The resultant mass spectrum for angiotension is shown in FIG. 11.

Figure 12:
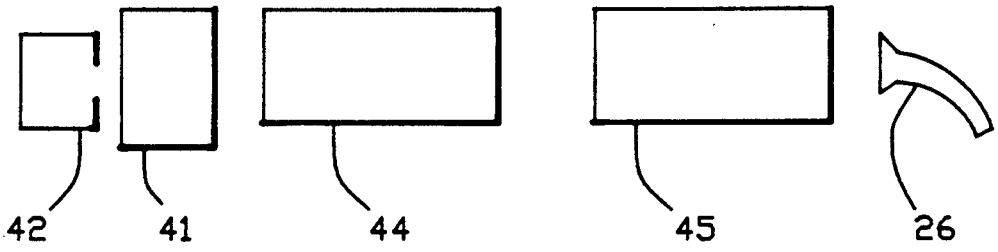
FIG. 12 shows an in-line surface collision means in a linked scan mass spectrometer.
Figure 13:
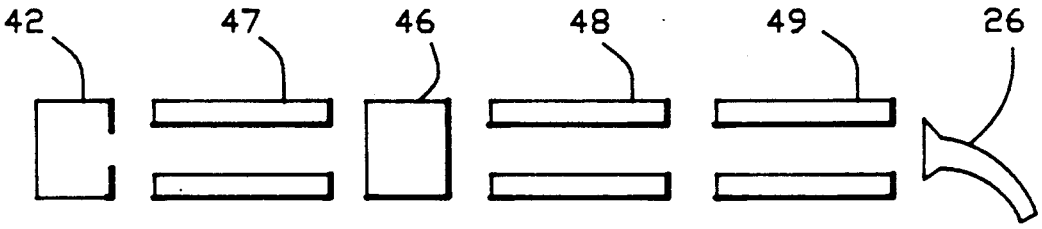
FIG. 13 shows an in-line surface collision means in an M/S, M/S mass spectrometer also capable of CID.

The in-line surface collision means can be used in connection with other mass analyzer combinations. For example, it can be used in a linked scan arrangement as shown in FIG. 12. The in-line surface collision means 41 is placed between the ion source 42 and the first of the two linked analyzers 44 and 45. It may also be used in an MS/MS arrangement as shown in FIG. 13. The in-line surface collision means 46 is placed between the first mass analyzer 47 and the RF only analyzer 48. A second mass analyzer 49 receives the output of the RF analyzer. Other combinations will be apparent to those skilled in the art. It will also be apparent to those skilled in the art that other analyzers, such as magnetic or electric sector analyzers, can be used in place of the quadupole mass analyzers shown.

Thus, there has been provided a simple device which can be used in connection with existing mass spectrometers of various types to provide an in-line collision surface for performing ion fragmentation reaction, and ion reflection studies and which can also be used to study the composition of the collision surfaces.

We claim:

1. A mass spectrometer including:
a mass analyzer for analyzing ions;
means for directing a beam of ions to be analyzed toward said mass analyzer along the axis of said analyzer;
surface collision means including a deflector and a collision surface positioned along said axis whereby said ions are deflected by said deflector and collide with said collision surface and undergo surface collision processes and generate surface collision products;
means for focusing and directing said surface collision products along said axis to said mass analyzer; and
means for detecting the output of said mass analyzer.

2. A mass spectrometer as in claim 1 in which said means for directing the ion beam to said analyzer comprises a second analyzer.

3. A mass spectrometer as in claim 2 in which said second analyzer is a quadrupole mass analyzer disposed along said axis.

4. A mass spectrometer as in claim 2 in which said second analyzer is a magnetic sector.

5. A mass spectrometer as in claim 2 in which said second analyzer comprises an electric sector.

6. A mass spectrometer as in claim 1 in which the collision means comprises input apertures, an ion collision surface and output apertures disposed on said axis.

7. A mass spectrometer as in claim 1 in which the collision surface is cylindrical.

8. A mass spectrometer as in claim 1 in which the means for directing ions to said collision means comprises an ion source.

9. A mass spectrometer including:
a mass analyzer for analyzing ions;
means for directing a beam of ions to be analyzed toward said mass analyzer along the axis of said analyzer;
surface collision means including a conical collision surface positioned along said axis to intercept said ions, input apertures and output apertures disposed on said axis, whereby said ions collide with said surface collision means and undergo surface collision processes and generate surface collision products;
means for focusing and directing said surface collision products along said axis to said mass analyzer; and
means for detecting the output of said mass analyzer.

10. A mass spectrometer including:
a mass analyzer for analyzing ions;
means for directing a beam of ions to be analyzed toward said mass analyzer along the axis of said analyzer;
surface collision means including a planar collision surface positioned perpendicular to said beam and along said axis to intercept said ions, input apertures and output apertures disposed on said axis, whereby said ions collide with said surface collision means and undergo surface collision processes and generate surface collision products;
means for focusing and directing said surface collision products along said axis to said mass analyzer; and
means for detecting the output of said mass analyzer.

11. A mass spectrometer for analysis of samples comprising:
an ion source for providing sample ions;
a first analyzer;
means for directing sample ions into and along the axis of the first analyzer, said analyzer forming an ion beam;
a second analyzer disposed in-line with said ion beam along said axis;
collision means disposed on said axis between said first and second analyzers to receive the ion beam, said collision means including a deflector and a collision surface whereby sample ions leaving the first analyzer may impinge with selected kinetic energy on either said deflector or said collision surface to form collision products;

means for directing and focusing said collision products to said second analyzer; and a detector responsive to the output of the second mass analyzer.

12. A mass spectrometer as in claim 11 in which said collision means includes:

input apertures on said axis for directing ions to said collision surface.

* * * * *

UNITED STATES PATENT AND TRADEMARK OFFICE

CERTIFICATE OF CORRECTION

PATENT NO. : 5,026,987

DATED : June 25, 1991

INVENTOR(S) : Mark E. Brier, et al.

It is certified that error appears in the above-identified patent and that said Letters Patent is hereby corrected as shown below:

At column1, line 7, insert --This invention was made with Government support under Grant no. CHE-85-21634 awarded by the National Science Foundation. The Government has certain rights in this invention.--

Signed and Sealed this

Seventh Day of September, 1993

Bruce Lehman

*Attest:*

BRUCE LEHMAN

*Attesting Officer*

*Commissioner of Patents and Trademarks*